10/22/85 OR 4,548,595

United States Patent [19]

Heater et al.

[11] Patent Number: 4,548,595

[45] Date of Patent: Oct. 22, 1985

[54] FOLDER

[75] Inventors: Charles P. Heater, Lake Lure, N.C.; Bruce H. Cooper, Fountain Inn, S.C.

[73] Assignee: Opelika Manufacturing Corp., Chicago, Ill.

[21] Appl. No.: 516,652

[22] Filed: Jul. 25, 1983

[51] Int. Cl.[4] ..... B31B 1/26

[52] U.S. Cl. ..... 493/458; 493/937

[58] Field of Search ..... 493/937, 458, 444, 23, 493/28, 19, 18

[56] References Cited

U.S. PATENT DOCUMENTS

| | | | |
|---|---|---|---|
| 1,203,722 | 11/1916 | Fulk . | |
| 2,645,476 | 2/1953 | Wood et al. | 493/28 |
| 3,467,370 | 9/1969 | Grantham | 493/21 |
| 3,495,819 | 7/1967 | Davidson | 270/79 |
| 3,552,737 | 1/1971 | Iltis | 493/19 |
| 3,829,081 | 8/1974 | Gerstenberger et al. | 270/66 |
| 3,905,593 | 9/1975 | Behn | 493/937 |
| 4,057,241 | 11/1977 | Buss et al. | 493/937 |
| 4,093,205 | 6/1978 | Kober | 493/937 |
| 4,227,684 | 10/1980 | Brocklehurst | 270/67 |
| 4,264,066 | 4/1981 | Meenen et al. | 493/937 |

FOREIGN PATENT DOCUMENTS

| | | |
|---|---|---|
| 572783 | 11/1958 | Belgium . |
| 7414903 | 11/1974 | Netherlands . |

*Primary Examiner*—Francis S. Husar
*Assistant Examiner*—Linda McLaughlin
*Attorney, Agent, or Firm*—Thomas & Kennedy

[57] ABSTRACT

Towels or other segments of sheet material are moved along an upper pair of downwardly inclined guide plates 31, 32, and the side edge portions 16 of the segments are folded inwardly and under the central portion 20 of the segment and under the upper guide plates. The leading end portion of the segment is moved off the lower ends of the upper guide plates and onto a lower pair of guide plates 34, 35 that are coextensive with the upper guide plates, the two pairs of guide plates are then separated, and a fold blade 101 moves upwardly between the separated guide plates to form a cross fold 106 intermediate the ends of the segment. The movement of the intermediate folded portion of the segment is continued in an upwardly-inclined direction, which pulls the leading and trailing end portions together.

12 Claims, 13 Drawing Figures

4A
4B
4C
4D
4E
12
15
16
17
20
21
22
24
26
31
32
69
69a
70
71
72
74
77
110
111
112
113
115
116
117
121
122
124
125
127
10b
10c
10d
10f
10g

FOLDER

BACKGROUND OF THE INVENTION

This invention relates to a folder for folding towels and other segments of sheet material and various flat goods such as garments, by first folding the segments in a French fold where the side edge portions are folded beneath the central portion, and then folding the French-folded segment across its length. More particularly, the invention relates to a folding method and apparatus which accurately folds towels and other flat goods in a French fold configuration and with a cross fold, with the folded portions being in proper proportion regardless of the size and proportions of the work piece.

In the folding of sheet material in laundries and other commercial establishments where large numbers of towels, etc. are folded, it is desirable that each towel or other segment of sheet material be folded to the proper size and in proper proportion. For example, one of the more popular folds for towels is a French fold, where the side longitudinal edges of a towel are folded onto the central longitudinal portion of the towel, and then the French-folded towel is folded in half, across its length. It is highly desirable that the segments of sheet material be folded to the right proportion; that is, that the relatively narrow towels, etc. be folded so that their side edge portions extend fully across the central longitudinal portion, and then folded across their lengths exactly halfway between the ends of the segment, so that the ends will be placed one upon the other.

As illustrated in U.S. Pat. No. 3,829,081, various folding machines have been developed in the past for folding towels, etc. The common problems found in most folders are that the towels, etc. are folded with one end portion of the French fold being narrower than the other end. Also, the cross fold is not located at the midpoint of the towel. This causes the French fold on one side of the cross fold to be narrower or wider than the other half of the towel, and one end portion of the French-folded segment extends beyond the other end portion.

While various mechanical adjustments to the folding equipment can be attempted in order to correct the improper folding of the segments of sheet material, if the size or shape of the segments change from one segment to the next, the mechanical adjustments must be made to properly fold the subsequent segments that are different in size or shape. For example, if one towel is a "beach" towel of large size and is to be folded in the machine, and a subsequent towel is a smaller "bath" towel, the prior art equipment must be adjusted in order to have both towels folded so that their ends will meet in the final folded configuration.

SUMMARY OF THE INVENTION

Briefly described, the present invention comprises a method and apparatus for folding towels and other segments of sheet material, wherein the segments are accurately formed in a French fold, and then folded across its length in half with the opposite ends positioned accurately adjacent each other. The folder comprises a first pair of downwardly-inclined guide plates and a second pair of downwardly-inclined guide plates that are coextensive with the first pair. Conveyor means moves towels or other segments of sheet material in series along their lengths down the guide plates with the side edge portions of the segments draped downwardly from opposite edges of the guide plates. Fold guides extend inwardly beneath the first guide plates and progressively fold the side edge portions of the segments inwardly beneath the guide plates and beneath the longitudinal central portion of each segment as the segments move down the first pair of inclined guide plates. The leading end portion of each segment moves off the lower end portions of the first pair of guide plates and onto the second pair of guide plates. A detector senses the movement of the segments of sheet material along the guide plates, and as each segment moves halfway onto the second pair of guide plates, the pairs of guide plates separate and a fold blade moves upwardly between the pairs of guide plates to form a cross fold in the segment. The cross-folded portion of the segment is then moved in an upwardly slope direction, thereby pulling the leading and trailing end portions of the segment behind it, which completes the cross-folding function. Each folded segment is then moved in sequence to a stacker where a stack of the segments is formed for subsequent handling.

The folder apparatus is constructed so that both pairs of its downwardly-inclined guide plates are adjustable in width, with the guide plates of each pair being movable toward and away from each other to accommodate towels or other segments of sheet material of varying widths. Moreover, the upper and lower pairs of guide plates are adjustable simultaneously without interrupting the operation of the folder apparatus, and only one adjustment function is required to adjust both pairs of guide plates.

A detector and control system are used to actuate the cross-folding procedure wherein the segments are accurately folded in half so that their ends are aligned.

Thus, it is an object of this invention to provide a folder which accommodates segments of sheet material of varying size and which functions to fold the segments in a properly proportioned French fold and in equal halves across its length.

Another object of this invention is to provide a method and apparatus for folding towels and other rectangular segments of sheet material in a cross-folded French fold, with the apparatus being adjustable to accommodate segments of varying widths, and with the apparatus functioning automatically to form a cross fold exactly at the midpoint of the segment so that the opposite ends of the segments are located adjacent each other.

Another object of this invention is to provide a folder for rectangular segments of sheet material such as towels that functions to form a cross-folded French fold in the segments, with the folder being inexpensive to construct and to maintain, and with the folder functioning automatically to accommodate segments of sheet material of varying lengths.

Other objects, features and advantages of the present invention will become apparent upon reading the following specifications, when taken in conjunction with the accompanying drawings.

DETAILED DESCRIPTION

Figures 1, 2:
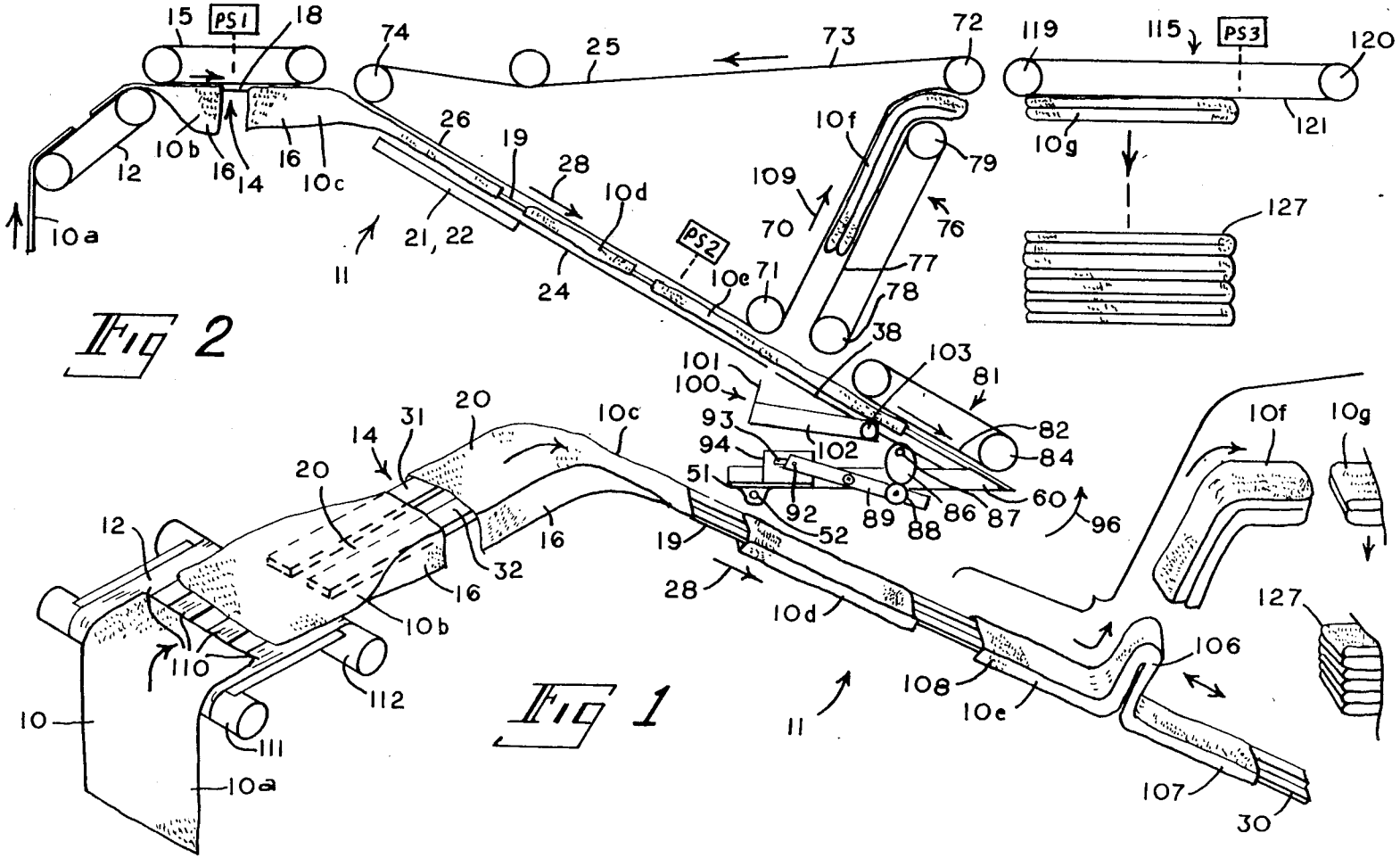
FIG. 1 is a schematic perspective illustration of a portion of the folder, showing the manner in which the segments of sheet material are progressively folded into a French fold and then folded across their lengths and subsequently stacked.
FIG. 2 is a schematic side view of the folder, showing the conveyor belts, the guide plates and their related elements, and illustrating how a series of segments of sheet material are handled by the folder.

Referring now in more detail to the drawings, in which like numerals indicate like parts throughout the several views, FIG. 1 illustrates the movements of towels 10 or other segments of rectangular sheet material through a folder 11, wherein segment 10*a* is placed by a worker (not shown) on a surface belt conveyor belt 12 and moved through the folder. As illustrated in FIG. 2, surface conveyor 12 moves the segment 10*a* up an incline and onto upper guide means 14. Top belt conveyor 15 moves its lower flight across the first guide means 14 so that the segment 10*a* continues its movement, as illustrated by segment 10*b*. The segments are wider than the first guide means 14, so that the side edge portions 16 and 17 hang downwardly from opposite edge portions of the first guide means 14.

As illustrated in FIG. 2, the first guide means 14 includes a horizontal section 18 and a downwardly-sloped section 19. A pair of fold plates 21, 22 (FIG. 4) are positioned in closely spaced relationship beneath the downwardly-sloped section 19 of first guide means 14 and function to fold the side edge portions 16 and 17 inwardly beneath the central portion 20 of the segment. Support plate 24 extends from the lower fold plate 21 further down the incline of the sloped section 19 of the first guide means so as to support the folded side portions of the segments 10*c*, 10*d*, 10*e*.

As illustrated in FIG. 2, top belt conveyor 25 has a first lower flight 26 that extends down the sloped first guide means 14 and engages the upper surface of the central portion 20 of each segment 10 and moves the segments in the direction as indicated by arrow 28. The downwardly-sloped section 19 of first guide means 14 and the first lower flight 26 of top belt conveyor 25 extend at an angle of approximately 30° with respect to the horizontal. The downwardly-sloped section 19 of first guide means 14 is supported in a cantilever arrangement from the horizontal section 18, so that the lower, distal end portion 29 is free and the segments 10 can wrap around the guide means and slide off the lower end portion.

A second or lower guide means 30 is positioned parallel to and coextensive with first guide means 14 and is supported in a cantilever arrangement at its lower portion so that its upper distal end portion is free to receive the segments 10 of sheet material from the first guide means 14.

Figure 5:
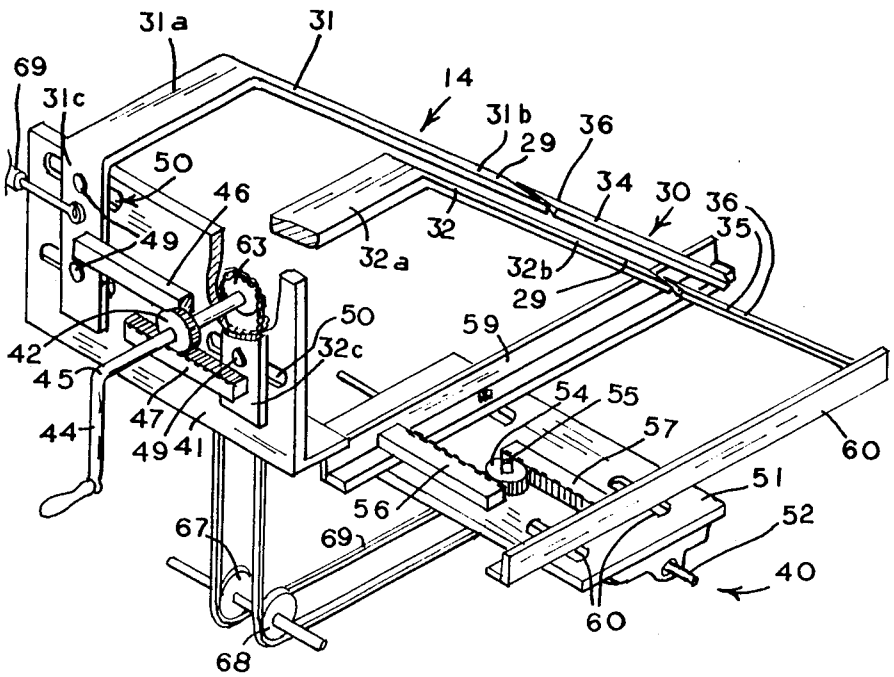
FIG. 5 is a perspective illustration of the width adjustment mechanism of the guide plates.

As illustrated in FIG. 5, both the first guide means 14 and second guide means 30 are formed by two parallel guide plates. The first guide means 14 comprises guide plates 31 and 32, with the horizontal section 18 of the first guide means 14 formed by horizontal sections 31*a* and 32*a*, and the with the downwardly-sloped section 19 of the first guide means 14 formed by downwardly-sloped sections 31*b* and 32*b*. In like manner, second guide means 30 comprises a pair of guide plates 34 and 35 that are also parallel to one another. The guide plates 34 and 35 are also supported in cantilever arrangement and have their upper, free ends 36 aligned with the lower, free ends 29 of the guide plates 31, 32. With this arrangement, the segments 10 of sheet material can slide directly off the lower end portions 29 of the upper guide plates 31 and 32 onto the upper end portions 36 of the lower guide plates 34 and 35. A support plate 38 is supported in closely spaced relationship beneath and parallel to the lower guide plates 34 and 35 and is coextensive with support plate 24 for the purpose of receiving the folded side edge portions from support plate 24 and supporting the folded side edge portions of the segments of sheet material and maintaining the folds as the leading edge portion of each segment is moved off the lower ends of the upper guide plates 31 and 32 and onto the lower guide plates 34 and 35.

As illustrated in FIG. 5, an adjusting means 40 is provided for changing the space between the upper guide plates 31 and 32 and between the lower guide plates 34 and 35. Adjusting means 40 comprises upper, stationary support plate 41 and rotatable gear or pinion 42 mounted on a crank 44, with the crank axle 45 extending through and rotatably supported by support plate 41. Upper and lower racks 46 and 47 have their teeth in facing relationship and in engagement with the teeth of the pinion 42. Each rack 46 and 47 is rigidly connected to a guide plate 31 and 32, respectively. The guide plates 31 and 32 include vertically-extending support segments 31*c* and 32*c*, and the guide plates are moveably supported on the support plate 41 by means of connectors 49 extending through the vertical segments 31*c* and 32*c* and through horizontal slots 50 formed in the support plate 41. With this arrangement, when crank 44 is rotated, its pinion 42 will move the racks 46 and 47 in opposite directions, thereby either drawing the guide plates 31 and 32 closer together or spreading them further apart, depending on the direction of rotation of pinion 42.

In a similar arrangement, the lower guide plates 34 and 35 are mounted on a rocking support plate 51, with the support plate being pivotable about horizontal axle 52. A gear or pinion 54 is rotatably mounted to axle 55 that extends through support plate 51, and a pair of racks 56 and 57 have their teeth in facing relationship and in engagement with the teeth of the pinion 54. The racks 56 and 57 are each rigidly connected to a support arm 59 and 60, with the support arms having connectors (not shown) extending therethrough and extending through the slots 61 of the support plate 51. The lower end portions of guide plates 34 and 35 are each rigidly mounted to a support arm 59 or 60. With this arrangement, when pinion 54 is rotated, it moves the support arms 59 and 60 in opposite directions, thereby either drawing the guide plates 34 and 35 closer together or spreading them further apart, depending on the direction of rotation of the pinion 54.

Timing gears, such as gear 63, are mounted on the axles 45 and 55 of the pinions 42 and 54, and timing chain 65 extends about the timing gears. Sprockets 67 and 68 are located beneath timing gear 63 and horizontally with respect to the timing gear of pinion 54, so that the timing chain 65 extends in vertical and horizontal directions about the timing gears. With this arrangement, when the crank 44 is rotated so as to rotate pinion 42 and cause the upper guide plates 31 and 32 to be moved with respect to each other, timing chain 65 causes an equal rotation of its pinion 54, causing equal movement of the lower guide plates 34 and 35. With this arrangement, the upper and lower guide plates 31, 32 and 34, 35 will always be coextensive, and the width adjustment of the guide plates can be made simultaneously with the rotation of crank 44.

Figures 4, 4A, 4B, 4C, 4D, 4E:
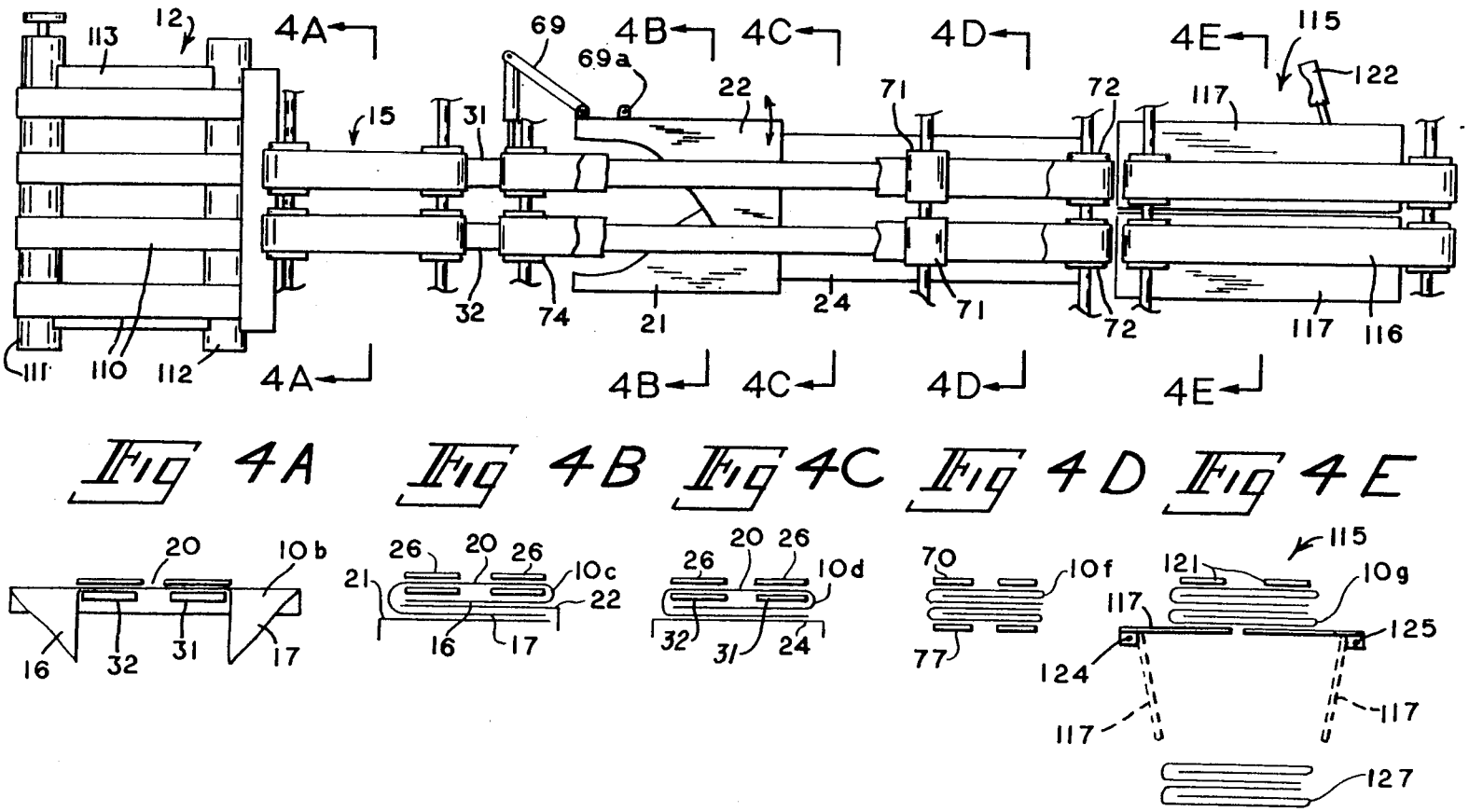
FIG. 4 is a top view of the conveyor system of the folder.
FIGS. 4A, 4B, 4C, 4D and 4E are progressive schematic illustrations of segments of sheet material as the segments move through the folder, as taken along lines 4A—4A, 4B—4B, 4C—4C, 4D—4D and 4E—4E of FIG. 4.

As illustrated in FIGS. 4 and 5, linkage 69 is connected at one end to the vertical segment 31*c* of support plate 31 and at its other end to fold plate 22 which pivots about pivot pin 69*a*. The end of linkage 69 is pivotably connected to fold plate 22, and fold plate 22 also is pivotably supported on pivot pin 69*a*. With this arrangement when the support plates 31 and 32 are spread apart or drawn together by the rotation of crank 44, linkage 69 pivots fold plate 22 at pivot 69*a* causing fold plate 22 to maintain a constant fold position beneath guide plate 32.

As illustrated in FIG. 4, the top belt conveyor 25 comprises two belts in side-by-side relationship, and the conveyor belts include a second lower flight 70 (FIG. 2) which extends upwardly from sheaves 71 at a right angle with respect to first lower flight 26, and the belts then extend about the upper sheaves 72, and then form an upper return flight 73 that extends back to the first sheaves 74. Inclined conveyor 76 includes an upper flight 77 that is substantially parallel to second lower flight 70 of top belt conveyor 25, with the belts of the inclined conveyor extending about sheaves 78 and 79. Surface conveyor 81 extends over and parallel to guide plates 34 and 35, with the lower flight 82 normally in engagement with the upper surfaces of the guide plates 34 and 35. The conveyor belts extend about sheaves 83 and 84. The surface belt conveyor 81 tends to continue the movement of the folded segments 10 as the leading end portion of each folded segment moves off the upper guide plates 31 and 32 and onto the lower guide plates 34 and 35.

Figure 3:
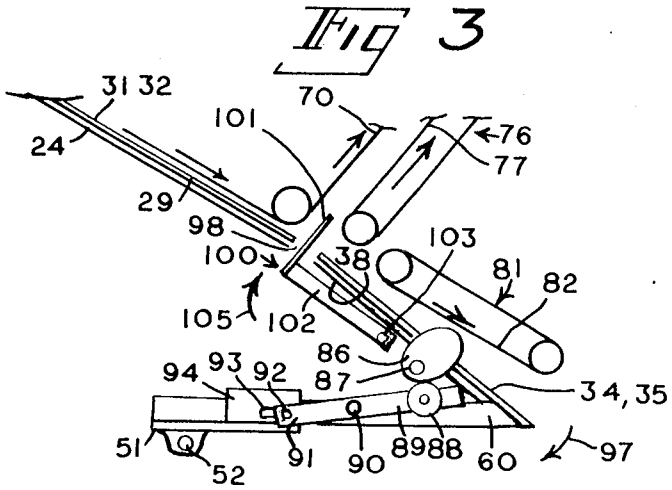
FIG. 3 is a detail side view showing the fold blade, showing the second pair of guide plates in their retracted position and the fold blade inserted upwardly between the first and second pairs of guide plates.

As illustrated in FIGS. 2 and 3, the axle 52 of rocking support plate 51 of the adjusting means 40 functions as a pivot axis for the lower guide plates 34 and 35. Cam 86 is rotatable about cam axle 87, and cam 86 rotates against cam follower 88 of cam lever 89. Cam lever 89 rocks about pivot 90 which is located intermediate the ends of the cam lever, and the distal end portion 91 of the cam lever includes a pin 92 that is received in slot 93 of a block 94 mounted to rocking support plate 51. With this arrangement when cam 86 urges cam follower 88 in a downward direction, cam lever 89 rocks in a clockwise direction, urging block 94 and rocking support plate 51 in a counterclockwise direction, in the direction as indicated by arrow 96, bringing the upper, distal end portions of the lower guide plates 34 and 35 toward abutment with the lower, distal end portions of the upper guide plates 31 and 32. When the cam 86 is rotated so that its lobe extends away from cam follower 88 (FIG. 3), the cam lever 89 rotates in a counterclockwise direction so that block 94 and rocker support plate 51 rotate in a clockwise direction as indicated by arrow 97, which causes the upper distal end portions of lower guide plates 34 and 35 to move away from the lower distal end portions of the upper guide plates 31 and 32, to form a gap 98 (FIG. 3) therebetween. It will be noted in FIG. 3 that the axle 52 of the rocking support plate 51 is located approximately in a plane extending perpendicular to the upper ends of the guide plates 31 and 32 at the lower distal ends of the upper guide plates. With this arrangement, the lower guide plates 34 and 35 will rock downwardly away from surface belt conveyor 81 (FIG. 3), so that when the lower guide plates are rocked away from the upper guide plates the lower flight 82 of the conveyor belt 81 will not engage a segment of sheet material that is present on the lower guide plates 34 and 35.

As illustrated in FIGS. 2 and 3, fold blade assembly 100 includes a fold blade 101 mounted on a pair of rocker arms 102, with the rocker arms being pivotably mounted on an axis 103. The axis 103 is located approximately in the plane of the upper guide plates 31 and 32. The rocker arms 102 also include a cam follower (not shown) that engages a cam 140 (FIG. 7) that is also mounted to cam axle 87. Therefore, when cam axle 87 is rotated, fold blade 101 is oscillated between the positions illustrated in FIGS. 2 and 3. The shape of the cam that oscillates fold blade assembly 100 is formed so that the fold blade assembly moves in an upward arc as indicated by arrow 105 after the lower guide plates 34 and 35 have been separated from the upper guide plates 31 and 32 to leave a gap 98 therebetween. The fold blade 101 will extend between the guide plates 31, 32 and 34, 35, upwardly between the facing flights 70 and 77 of the top belt conveyor 25 and the inclined belt conveyor 76. When the fold blade 101 is moved out from between the flights 70 and 77 and downwardly from between the adjacent end portions of the guide plates 31, 32 and 34, 35, the guide plates are moved back toward abutment with one another by their cam 86. The rotational movement of cam axle 87 is controlled by a control system to be described later.

As illustrated in FIGS. 1 and 2, when the fold blade assembly 100 is actuated by its cam so that the fold blade 101 moves up between the guide plates 31, 32 and 34, 35, the fold blade forms a cross fold 106 (FIG. 1) in the Fench-folded segment 10*a*. The cross fold 106 will be located intermediate the leading and trailing end portions 107 and 108 of the segment, and the cross fold will be urged in between the facing flights 70 and 77 of top conveyor 25 and inclined conveyor 76. The facing flights of the two conveyors move up a 60° incline as indicated by direction arrow 109, and carry the cross-folded portion of the segment up the incline. The leading end portion and trailing end portion of the segment follow the cross-folded portion of the segment of sheet material, so that the entire segment moves up the incline.

In order that there be no wrinkling of the segment of sheet material, the fold blade 101 is urged by its cam 140 upwardly through the gap 98 and between the facing flights 70 and 77 at a velocity aproximately equal to the belt velocity of the folder, so that the cross-folded portion 106 moves up into the facing flights 70 and 77 at a velocity compatible with the downward-sloped movement of the trailing end portion of the segment along the upper guide plates 31 and 32.

As illustrated in FIG. 4, the surface belt conveyor 12 comprises a plurality of belts 110 extending about a pair of elongated belt rollers 111 and 112, with the upper flights of the belts extending over a work surface 113. The belt conveyors extending on beyond surface conveyor 12 comprise pairs of belts that are spaced apart a distance compatible with the spacing between the guide plates 31, 32 and 34, 35.

As illustrated in FIGS. 2 and 4, stacker 115 is located ajacent the sheaves 72 of top belt conveyor 25 and comprises upper belt conveyor 116 that extends across folding plates 117. When a segment 10*f* of sheet material moves up the inclined path illustrated by arrow 109 and emerges from between sheaves 72 and 79, the leading cross-folded portion of the segment moves out onto the folding plates 117. The belts of the upper belt conveyor 116 extend about sheaves 119 and 120, and the lower flight 121 of the upper belt conveyor urges the segments onto the folding plates, as indicated by segment 10*g*. When the leading cross-folded portion of the segment 10*g* reaches photo switch PS3, a pneumatic cylinder 122 is actuated, causing the folding plates to pivot downwardly about their side axles 124 and 125 (FIG. 4*e*), to permit the segments of sheet material to fall into a vertical stack 127. The photo switch PS3 also actuates a clutch-brake (not shown) which causes the movement of the upper belt conveyor 116 to terminate just prior to the opening of the folding plates 117, so that the stack 127 is accurately formed. This is conventional in the art.

As illustrated in FIGS. 4A–4E, when the segments of sheet material 10 move through the system, the segments are progressively folded. As illustrated in FIG. 4A, when the segment 10*b* is moving from the surface belt conveyor 12 onto the horizontal run of guide plates 31 and 32, the side edge portions 16 and 17 are free to fall or drape downwardly from the side edges of the guide plates 31 and 32. As the segments move further through the system as indicated by segment 10*c* of FIG. 4B, the fold plates 21 and 22 fold the side edge portions 16 and 17 beneath the central portion 20. As the segments move beyond the fold plates 21 and 22, the support plate 24 continues to hold the French fold formed in the segments, with the lower side portions of the segments folded beneath the upper guide plates 31 and 32. FIG. 4C illustrates the configuration of the segment 10*d* on both sides of the abutting free end portions of the guide plates 31, 32 and 34, 35. FIG. 4D illustrates the configuration of the segment 10*f* after it has been both French-folded and cross-folded and is moving up the 60° incline between the facing flights 70 and 77 of the top belt conveyor 25 and the inclined conveyor 76. FIG. 4E illustrates the segment 10*g* as it is positioned in the stacker 115. The dashed-line position of the folding plates 117 illustrates the position of the folding plates when the segment 10G is permitted to fall to the stack 127.

Figure 6:
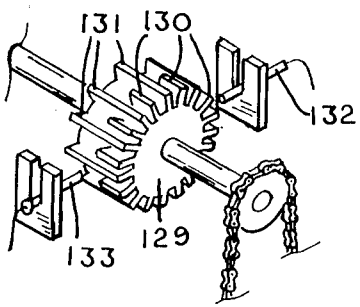
FIG. 6 is a detail illustration of the counting mechanism that controls the movements of the fold blade and second pair of guide plates.
Figure 7:
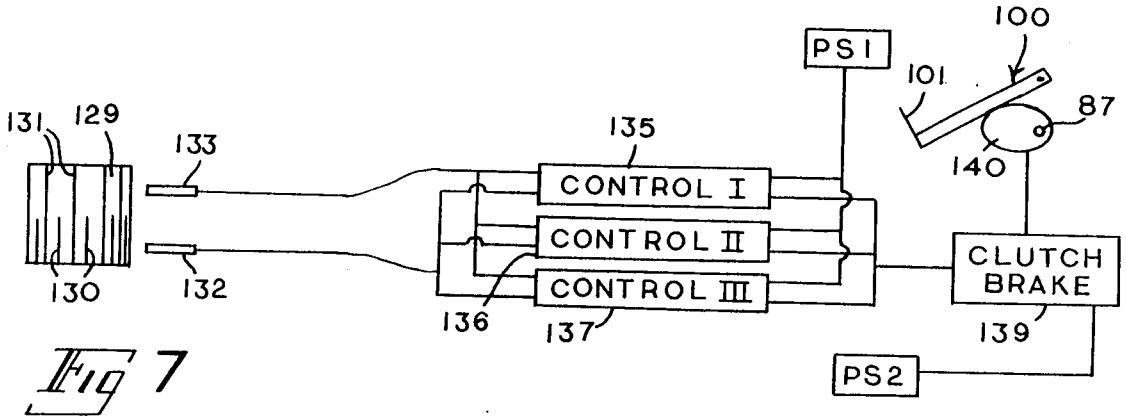
FIG. 7 is a circuit diagram of the control system.

As illustrated in FIGS. 6 and 7, one of the gears that rotates in unison with a sheave of top belt conveyor 25 is formed with alternate teeth 130 as half teeth and with the other alternate teeth 131 as full teeth. Proximity sensors 132 and 133 are positioned adjacent the paths of the teeth, with sensor 132 positioned to sense the movement of both the half teeth and full teeth, and with sensor 133 positioned to sense the movement of only the full teeth. Photo switch PS1 (FIGS. 2 and 8) is located above the first pair of guide plates 31 and 32 at the top belt conveyor 15, at a position so that it senses downwardly between the conveyor belts, to sense the presence of a segment 10 of the sheet material as the segment moves in response to the conveyor system toward the abutting ends of the upper guide plates 31 and 32 and of the lower guide plates 34 and 35.

Figure 8:
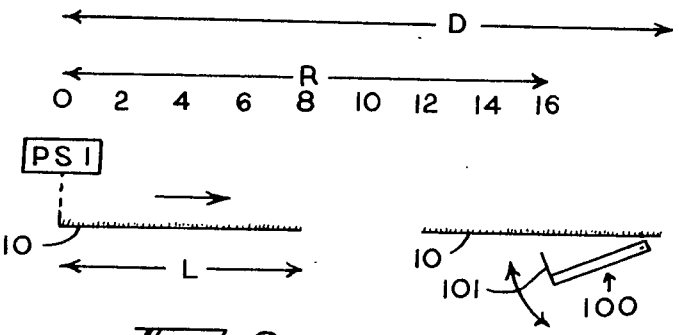
FIG. 8 is a schematic illustration of the timing of the movement of the fold blade as segments of sheet material move through the folder.

As illustrated in FIG. 8, the distance between photo switch PS1 and the abutting ends of the guide plates 31. 32 and 34, 35 is divided into distance increments that correspond to the spacing between all of the teeth of gear 129 (FIG. 6). That is, when the leading edge of a segment 10 moves from the position of proximity switch PS1 to the abutting ends of the guide plates, the gear 129 (FIGS. 6 and 7) will rotate a predetermined number of degrees, and each tooth 131 and 130 of the gear will pass proximity sensor 132. In the embodiment illustrated herein, the rotation of the gear is such that sixteen of the teeth 131 and 130 will move past the proximity sensor 132 as the leading edge traverses the space between proximity switch PS1 and the abutting ends of the guide plates.

When the proximity switch PS1 detects the segment 10 moving through the folder, one of the three control circuits 135, 136 or 137 is actuated, and the control circuit receives and counts the pulses from proximity sensor 133. Since proximity sensor 133 counts only the full teeth 131, only alternate teeth are counted, resulting in only one-half the units of measurement being counted as long as the proximity switch PS1 continues to detect the presence of a segment 10 moving through the folder.

When the trailing edge of the segment 10 moves beyond the proximity sensor PS1, the control circuit will have "measured" the segment and the control circuit receives and counts the pulses from proximity sensor 132 and therefore counts all of the teeth 130 and 131, until a count of sixteen of the distance measurements has been made. As illustrated in FIG. 8, since only one-half the distance measurements are counted as the segment 10 passes beneath the photo switch PS1, the leading edge portion of the segment will move twice the distance measurements counted by the control system until the trailing edge passes the priximity switch PS1. For example, if the segment is eight distance measurements long, only four distance measurements will have been counted as the segment passes beneath the photo switch PS1, and after the trailing edge moves from beneath the photo switch PS1, a full count of the remaining eight distance measurements will be counted by the control system until a full sixteen count has been made. This causes the leading edge of the segment 10 to move beyond the fold blade 101 and the abutting portions of the guide plates 31, 32 and 34, 35 a distance equal to one-half the length of the segment 10, so that the midpoint of the segment will be located above the fold blade 101. Therefore, when the fold blade 101 of the fold blade assembly 100 moves up and into engagement with the segment 10, the fold blade 101 will engage the midpoint of the segment.

The formula for determining the distance that the leading edge of the segment moves beyond the photo cell is:

$$D = R + (\tfrac{1}{2})L$$

where D = distance that the leading edge of the segment moves beyond the photo cell, where L = the length of the segment, and R = the distance from the photo cell to the folding position.

The worker that feeds the segments 10 of sheet material to the folder is likely to place the segments closely adjacent one another so that they move in closely-spaced relationship through the folder. In order to accommodate the close spacing of the segments through the folder, three of the control circuits 135, 136 and 137 are utilized to receive the counts from the proximity sensors 132 and 133. When the first control circuit 135 has been actuated by photo switch PS1 and completes its count, the control circuit 135 actuates the clutch 139 that rotates cam shaft 87 through a first arc of 180°. As cam shaft 87 rotates, one cam 86 moves the lower guide plates 34 and 35 away from the upper guide plates 31 and 32, and the other cam 140 oscillates the fold blade 101. In another segment 10 has been placed closely adjacent the preceeding segment, the photo switch PS1 will detect the space between the segments and then the presence of the subsequent segment and control circuit 136 will be actuated by the second detection of the proximity switch PS1. In like manner, the second control circuit 136 will count the pulses from proximity switch as previously described, so that the second segment will be cross-folded by the fold blade assembly 100. The detection of the third segment by photo switch PS1 will be received by the third control circuit 137, and the folder will function to form the cross fold in the third segment.

As illustrated in FIG. 2, photo switch PS2 is located adjacent the turn between the first lower flight 26 and the second lower flight 70 of the surface conveyor 25 and senses the movement of the trailing edge of the segments of sheet material. Photo switch PS2 senses the space between the adjacent segments 10 and causes the clutch 139 to rotate the cam shaft 87 through the second arc of 180°, which causes the separated end portions of the guide plates 31, 32 and 34, 35 to move back toward abutment with one another.

While this invention has been described as a method and apparatus for folding sheet material, it should be understood that the words "sheet material" are considered to include various flat, foldable work products of one or more plies, and while this invention has been described in detail with particular reference to a preferred embodiment thereof, it will be understood that variations and modifications can be effected within the spirit and scope of the invention as described hereinbefore and as defined in the appended claims.

We claim:

1. A method of folding segments of sheet material of varying lengths comprising moving segments in spaced series along their lengths in a direction parallel to their side edges along a first pair of rectilinear parallel support plates extending in a downwardly sloped direction and later onto a second pair of rectilinear support plates in abutment with and coextensive with said first pair of support plates with conveyor means juxtaposed both said first and second pairs of support plates, and as the segments move supporting the longitudinally extending central portions of each segment on the support plates and progressively folding the longitudinally extending side portions beneath the central portions of each segment to form a French fold; and folding each French-folded segment across its length at a position on the segment which is one-half the distance between its leading and trailing ends as said position on the segment reaches the position of abutment of said second pair of support plates with said first pair of support plates, the step of folding comprising moving said second pair of support plates in an arc out of abutment with said first pair of support plates and away from said conveyor means and urging the portion of the French folded segment spanning the first and second pairs of support plates in a direction normal to said support plates.

2. The method of claim 1 and wherein the step of moving the segment along its length comprises moving the leading edge of the segment past a detector and beyond the position of abutment of said support plates a distance equal to the distance between the detector and the position of abutment of said support plates plus one half the length of the segment.

3. The method of claim 1 and wherein the step of moving the segment along its length comprises advancing the segment past a detector to the postion of abutment with the postion of abutment located at a predetermined number of units of measurement beyond the detector, and as the segment moves past the detector counting only one-half the units of measurement moved by the leading edge until the trailing edge passes the detector and after the trailing edge passes the detector counting the units of measurement that the segment continues to move toward the position of abutment until all of the predetermined number of units of measurement have been counted, and in response to the predetermined number of units of measurement having been counted folding the segment intermediate its ends at the position of abutment.

4. Apparatus for folding segments of sheet material comprising first guide means for guilding segments along a predetermined path, first conveyor means for moving segments in series along said first guide means with the side portions of the segments hanging downwardly from opposite edges of the guide means, progressive fold members angled inwardly beneath said first guide means for progressively folding the side portions beneath said first guide means, second guide means normally in abutment with and coextensive with said first guide means for receiving the leading portion of the segment, with said first and second guide means being movable toward and away from abutment with each other, second conveyor means for moving the segments onto said second guide means means for moving said second guide means toward and away from aligned abutment with said first guide means and toward and away from said second conveyor means a fold plate, means for moving said fold plate between said first and second guide means when said second guide means is moved away from said first guide means and said second conveyor means to fold the segments across their lengths.

5. The apparatus of claim 4 and wherein said first and second guide means each comprise a pair of rectilinear parallel guide plates with the guide plates of one pair being coextensive with the guide plates of the other pair.

6. The apparatus of claim 5 and further including means for adjusting the distance between the guide plates of each pair of guide plates.

7. The apparatus of claim 5 and further including means for simultaneously adjusting the distance between the guide plates of each pair of guide plates.

8. The apparatus of claim 4 and wherein said first guide means comprises a first pair of rectilinear parallel guide plates each supported at one end portion and extending in a downwardly sloped attitude from their supported end portions and wherein said second guide means comprises a second pair of rectilinear parallel guide plates each supported at one end portion and extending in an upwardly sloped attitude from their supported end portions toward abutment with the first pair of guide plates, with the first and second pairs of guide plates being coextensive.

9. The apparatus of claim 8 and wherein said means for moving said fold blade between said first and second pairs of guide plates is constructed and arranged to move in an arc extending approximately normal to said guide plates.

10. The apparatus of claim 4 and further including conveyor means for receiving the portion of the segment folded by said fold blade and for moving the segment off the separated first and second guide means.

11. The apparatus of claim 4 and wherein said means for moving said second guide means torward and away from aligned abutment with said first guide means comprises detector means for detecting the movement of the leading edge of a segment toward the abutting portions of said first and second guide means, and counting means for counting one-half the units of measurement moved by the leading edge of the segment between said detector means and the abutting portions of said first and second guide means until the trailing edge of the segment is detected by the detector means and then counting all, the units of measurement moved by the leading edge of the segment until a predetermined number of units of measurement have been counted.

12. Apparatus for folding segments of sheet material comprising first guide means, a second guide means approximately coextensive with said first guide means. said first and second guide means each comprise a pair of rectilinear parallel guide plates supported in a cantilever arrangement with the distal end portions of the guide plates of one pair positioned adjacent the distal end portions of the guide plates of the other pair, and means for simultaneously adjusting the distance between the guide plates of each pair, fold guides angled from opposite side of the first guide means inwardly beneath said first guide means, conveyor means extending along the guide plates of said first and second guide means for moving segments of sheet material in series over the first guide means and the second guide means with opposite side portions of the segments extending downwardly from opposite sides of the first guide means whereby the fold guides progressively fold the side portions of the segments inwardly beneath the first guide means, means for moving the distal ends of the guide plates of the second guide means toward and away from the distal ends of the guide plates of the first guide means and toward and away from the conveyor means, and a fold means movable from adjacent said first and second guide means between the distal ends of the pairs of guide plates when said pairs of guide plates are moved away from each other and away from the conveyor means to urge the segments in a direction approximately normal to said first and second guide means.

* * * * *